US005420476A

United States Patent [19]

Nakamura et al.

[11] Patent Number: 5,420,476

[45] Date of Patent: May 30, 1995

[54] PHOTOMULTIPLIER INCLUDING ELECTION LENS ELECTRODE

[75] Inventors: Kimitsugu Nakamura; Takeo Hashimoto; Hiroaki Washiyama; Tomihiko Kuroyanagi, all of Hamamatsu, Japan

[73] Assignee: Hamamatsu Photonics K.K., Hamamatsu, Japan

[21] Appl. No.: 68,220

[22] Filed: May 27, 1993

[30] Foreign Application Priority Data

May 28, 1992 [JP] Japan ..... 4-136781

[51] Int. Cl.[6] ..... H01J 43/18

[52] U.S. Cl. ..... 313/537; 313/534

[58] Field of Search ..... 313/537, 534, 533, 532, 313/528, 526, 103 R, 103 CM, 105 R

[56] References Cited

U.S. PATENT DOCUMENTS

| | | | |
|---|---|---|---|
| 3,873,867 | 3/1975 | Girvin . | |
| 4,367,404 | 1/1983 | Kaye | 313/105 R |
| 5,043,628 | 8/1991 | Boutot et al. | 313/532 |
| 5,061,875 | 10/1991 | Tomasetti et al. | 313/557 |

FOREIGN PATENT DOCUMENTS 1443279 5/1966 France .

OTHER PUBLICATIONS

Patent Abstracts of Japan, vol. 15, No. 70 (E-1035) 19 Feb. 1991 & JP-A-02 291 655 (Hamamatsu Photonics K.K.) 3 Dec. 1990 *abstract*.

*Primary Examiner*—Sandra L. O'Shea
*Assistant Examiner*—Vip Patel
*Attorney, Agent, or Firm*—Cushman, Darby & Cushman

[57] ABSTRACT

An electron lens electrode for guiding photoelectrons emitted from a photocathode to an electron multiplier section is arranged between the photocathode and the light-incident portion of a sealed container, and an opening is formed at a portion of the electron lens electrode opposing the light-incident portion. Incident light reaches the photocathode through the opening without being scattered or absorbed at all. The transmittance of light incident on a photomultiplier is improved, and the output waveform is uniformed, resulting in an improved S/N ratio.

6 Claims, 9 Drawing Sheets

PHOTOMULTIPLIER INCLUDING ELECTION LENS ELECTRODE

BACKGROUND OF THE INVENTION

1. Field of the Invention

The present invention relates to a so-called side-on type photomultiplier on which light to be measured is incident from the side surface of its container and, more particularly, to make uniform the output waveform and improve the signal-to-noise S/N ratio of a photomultiplier.

2. Related Background Art

FIGS. 1 and 2 show a conventional photomultiplier. This photomultiplier is generally called a side-on type photomultiplier, and light as the measurement target is incident on the photomultiplier from the side surface of its glass bulb 1, which is a transparent sealed container. Light is transmitted through the glass bulb 1 and is incident on the photoelectric surface of a reflection type photocathode 2. As a result photoelectrons are emitted from the photoelectric surface and sent to an electronic multiplier section 3 constituted by a plurality of stages of dynodes 3*a* to 3*d*. The photoelectrons are sequentially multiplied by the electronic multiplier section 3, and the multiplied photoelectrons are collected as the output signal by an anode 4.

In order to guide the photoelectrons emitted from the photocathode 2 to the first-stage dynode 3*a*, a grid electrode 6 is arranged between a light-incident portion 5 of the glass bulb 1 and the photocathode 2 and set to the same potential as that of the photocathode 2. Various types of grid electrodes 6 are available. For example, a thin conductor wire is arranged literally in a grid-like manner (not shown) to constitute a grid electrode 6, or as shown in FIG. 1, one thin conductor wire 6*c* is spirally wound on two support rods 6*a* and 6*b* to constitute a grid electrode 6.

In the conventional photomultiplier as described above, because the grid electrode 6 is arranged in front of the photocathode 2, light incident on the photocathode 2 through the glass bulb 1 is partly scattered and absorbed by the conductor wire 6*c* of the grid electrode 6. Even if the incident light is uniform, a part of the light does not reach the photocathode 2. In general, the grid electrode 6 has a transmittance of 75%. Hence, 25% of the light does not reach the photocathode 2.

FIG. 3 is a graph showing the relationship between the position of a light spot formed and the output (relative value) of the anode 4 serving as the collector electrode when spot light is radiated as it is moved from an upper point a to a lower point b along the plane 2—2 of FIG. 1. Referring to FIG. 3, the output 60 is not uniform. The position of a recess in the output corresponds to the position of the conductor wire 6*c* of the grid electrode 6. It is apparent that the transmittance is decreased at this position.

As countermeasures against the problem of the decrease in transmittance, means disclosed in Japanese Patent Laid-Open Nos. 53-18864 and 55-29989 are known.

As shown in FIG. 4, according to the means disclosed in Japanese Patent Laid-Open No. 53-18864, a glass plate 7 having a transparent conductor film formed on its surface is used in place of the grid electrode 7.

When light is transmitted through a glass material, however, a loss occurs due to absorption or scattering. When the glass plate 7 is arranged in a glass bulb 1, light is transmitted through the glass material twice, doubling the loss.

Another problem arises in manufacture. More specifically, in the conventional manufacturing process of a photocathode 2, an alkali metal for forming the photoelectric surface flows as indicated by broken lines in FIG. 4 to reach the photoelectric surface. When the glass plate 7 is arranged in the moving path of the alkali metal, the alkali metal cannot be uniformly guided, making it very difficult to form a uniform photoelectric surface.

As shown in FIG. 5, according to the means disclosed in Japanese Patent Laid-Open No. 55-29989, although a grid electrode 6 is used, the grid density constituted by a conductor wire 6*c* of the grid electrode 6 is set high in a portion 6*d* close to a portion of the grid electrode 6 which is coupled to a photocathode 2 and low in a portion 6*e* through which most of the incident light is transmitted.

When the grid density of the grid electrode 6 is set low only partly, although the transmittance is increased as compared to that obtained in the conventional arrangement shown in FIG. 1. But the conductor wire 6*c* of the grid electrode 6 still serves as an obstacle to decrease the transmittance, leaving the problem unsolved. Different transmittances in different portions of the grid electrode 6 mean different transmittances of light to be incident in different portions on the photocathode 2. This causes non-uniformity in the sensitivity of the photocathode 2.

SUMMARY OF THE INVENTION

The present invention has been made in view of the above situation, and has as its object to improve the transmittance of light incident on a photomultiplier, and to uniform the output waveform, thereby improving the S/N ratio.

In order to achieve the above object, according to the first aspect of the present invention, there is provided a photomultiplier for guiding light incident through a light-incident portion of a translucent sealed container onto a reflection type photocathode therein to generate photoelectrons, multiplying the photoelectrons by an electronic multiplier section constituted by a plurality of stages of dynodes, and collecting the multiplied photoelectrons as an output signal, comprising an electron lens electrode, arranged between the photocathode and the light-incident portion, for guiding the photoelectrons emitted from the photocathode to the electron multiplier section, the electron lens electrode having an opening formed at a portion thereof opposing the light-incident portion.

According to the second aspect of the present invention, there is provided a photomultiplier comprising an electron lens electrode, arranged at a position adjacent to a first-stage dynode and opposing part of a light-incident portion, for guiding photoelectrons emitted from a photocathode to an electronic multiplier section.

In these photomultipliers, in order to meet the demand of improving hysteresis characteristics, they are preferably formed from a transparent conductor portion on the inner or outer wall surface of the light-incident portion of a sealed container.

According to the photomultiplier of the first aspect of the present invention, as the opening is formed in the electron lens electrode arranged between the photocathode and the light-incident portion of the sealed container, light incident from the light-incident portion reaches the photocathode through the opening in the electron lens electrode. Accordingly, uniform incident light directly reaches the photocathode, and an output at an anode becomes uniform.

It is apparent from experiments that it is sufficient if the electron lens electrode for guiding the photoelectrons by deflection is arranged between the photocathode and the light-incident portion of the sealed container and at a position at least adjacent to the first-stage dynode. Accordingly, by forming an opening in part of the electron lens electrode, or by causing the electron lens electrode to oppose only part of the light-incident portion, as in the photomultiplier according to the second aspect of the present invention, the photoelectrons emitted from the photocathode are effectively guided to the electronic multiplier section.

When the electron lens electrode is arranged to oppose only part of the light-incident portion, light incident from other portions of the light-incident portion reaches the photocathode without being interfered at all.

When an opening is formed in the photoelectron-deflecting electron lens electrode or the size of the electron lens electrode is decreased, some of the photoelectrons emitted from the photocathode may undesirably reach the light-incident portion of the sealed container to electrically charge this portion. Such electrical charging causes hysteresis in the photomultiplier output. When, however, a transparent conductor portion is formed on the inner or outer wall surface of the light-incident portion of the sealed container, the resistance in this portion on which the conductor portion is formed is decreased to prevent electrical charging, thereby preventing a hysteresis phenomenon.

The present invention will be more fully understood from the detailed description given below and the accompanying drawings, which are provided by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

DESCRIPTION OF THE PREFERRED EMBODIMENTS

Figure 1:
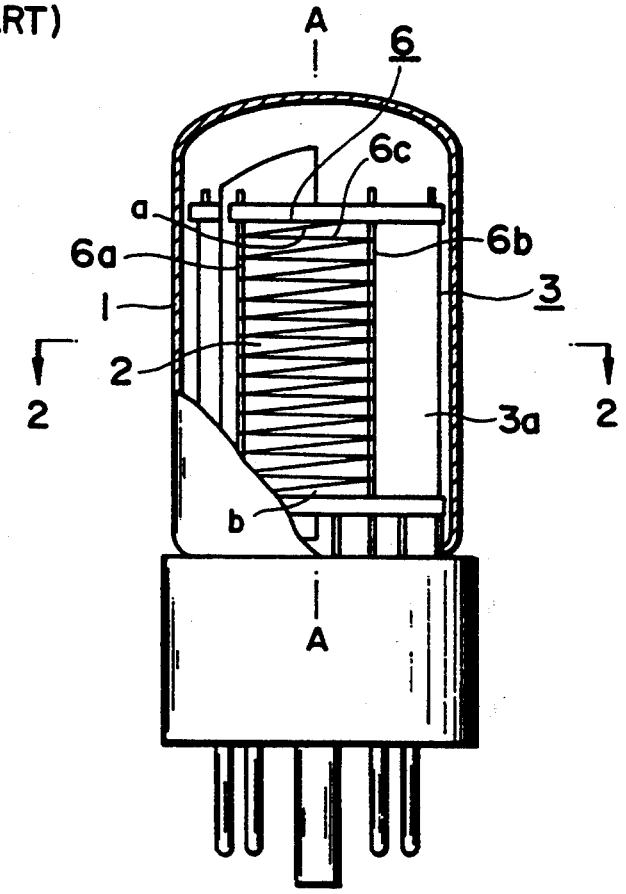
Fig. 1 (PRIOR ART)
FIG. 1 is a front view showing a conventional photomultiplier.
Figure 2:
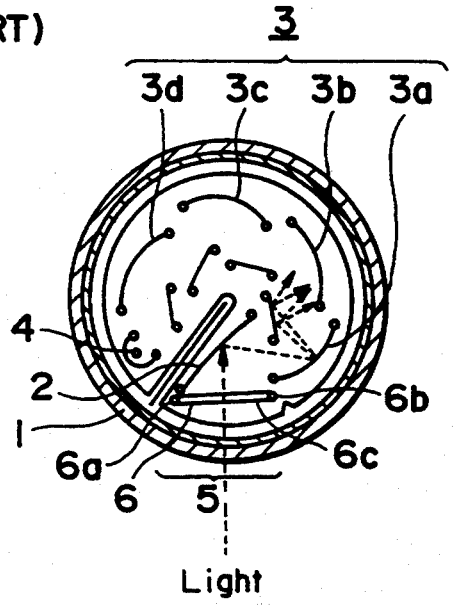
Fig. 2 (PRIOR ART)
FIG. 2 is a sectional view taken along the line 2—2 of FIG. 1.
Figure 3:
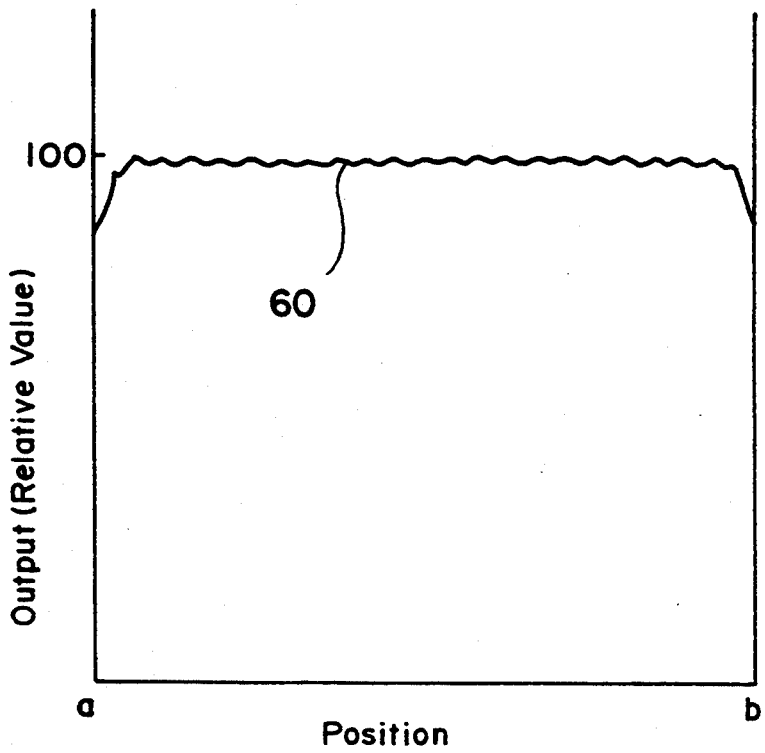
Fig. 3 (PRIOR ART)
FIG. 3 is a graph showing the relationship between the position of a light spot formed and the output when spot light is radiated on the conventional photomultiplier of FIG. 2.
Figure 4:
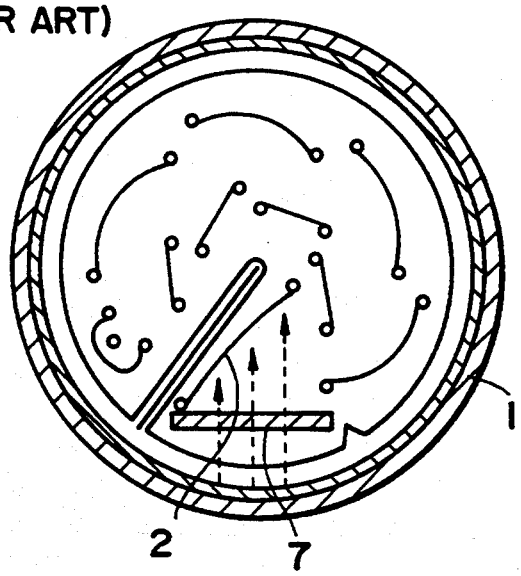
Fig. 4 (PRIOR ART)
FIG. 4 is a horizontally sectional view showing another arrangement of the conventional photomultiplier.
Figure 5:
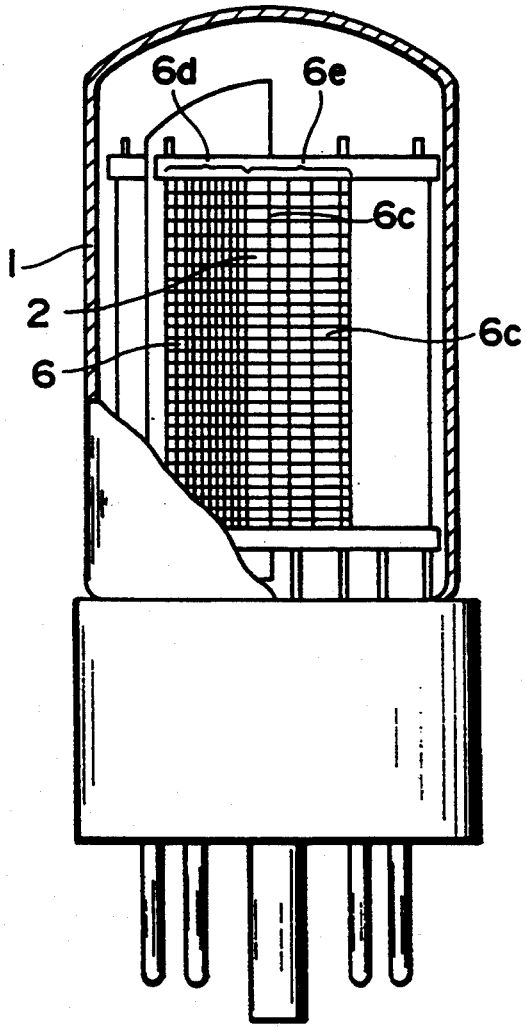
Fig. 5 (PRIOR ART)
FIG. 5 is a front view showing still another arrangement of the conventional photomultiplier.

The preferred embodiments of the present invention will be described in detail with reference to the accompanying drawings. The same or corresponding portions as in the conventional arrangements described above are denoted by the same reference numerals, and upper and lower, and right and left sides referred to in the following description are based on the upper and lower, and right and left sides of the drawings.

Figure 6:
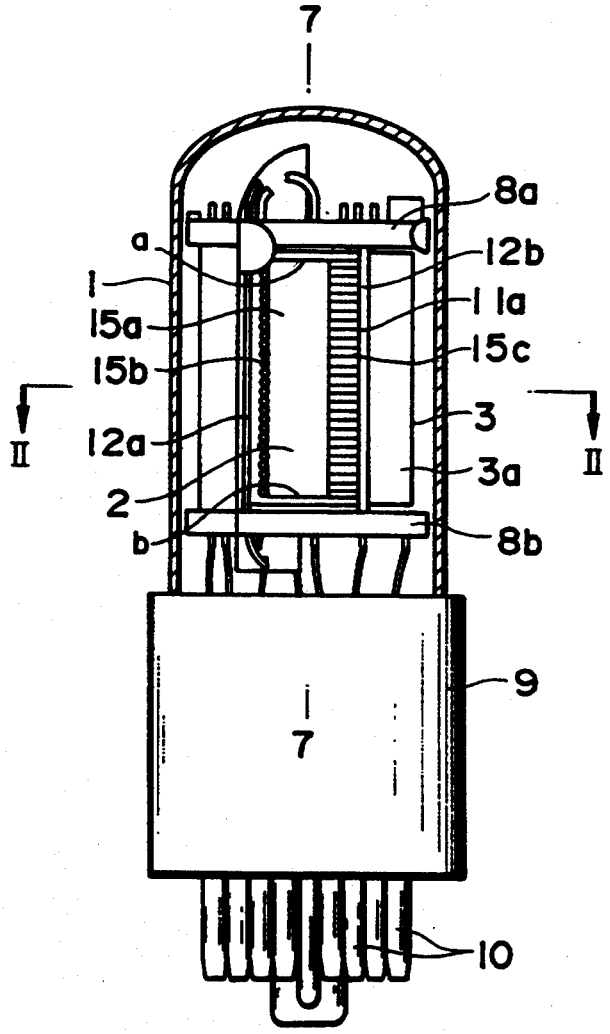
FIG. 6 is a front view showing a photomultiplier according to an embodiment of the present invention.
Figure 7:
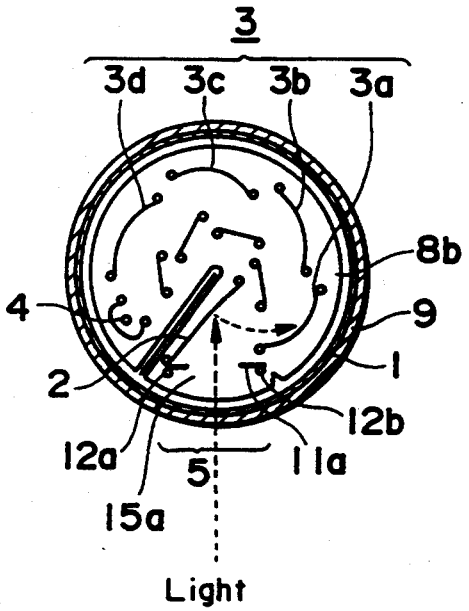
FIG. 7 is a sectional view taken along the line 7—7 of FIG. 6.

FIGS. 6 and 7 show a so-called side-on type photomultiplier according to the present invention. In FIGS. 6 and 7, reference numeral 1 denotes a translucent sealed container, more specifically, a transparent cylindrical glass bulb having closed upper and lower ends. Insulator plates 8*a* and 8*b* made of, e.g., a ceramic are provided in the upper and lower portions in the glass bulb 1. Various types of electrodes are supported by the insulator plates 8*a* and 8*b*. Terminals 10 extend to the outside from the bottom portion of the glass bulb 1 through a base 9. A photocathode 2, an electronic multiplier section 3, and an anode 4 are supported between the upper and lower insulator plates 8*a* and 8*b*. The photocathode 2 is inclined at a predetermined angle with respect to a light-incident portion 5 of the glass bulb 1. The electronic multiplier section 3 is constituted by a plurality of stages of dynodes 3*a* to 3*d* for sequentially multiplying the photoelectrons emitted from the photocathode 2. The anode 4 collects an output signal.

An electrode (electron lens electrode) 11*a*, serving as an electron lens to cause the photoelectrons emitted from the photocathode 2 to be effectively incident on the first-stage dynode 3*a*, is arranged between the light-incident portion 5 of the glass bulb 1 and the photocathode 2. In this embodiment, the electron lens electrode 11*a* is welded to support rods 12*a* and 12*b* supported by the upper and lower insulator plates 8*a* and 8*b*. However, the electron lens electrode 11*a* may be directly supported by the insulator plates 8*a* and 8*b* without using the support rods 12*a* and 12*b*.

The electron lens electrode 11*a* is a rectangular flat plate electrode. As shown in FIG. 6, a large rectangular opening 15*a* is formed in the central portion of the electron lens electrode 11*a*, i.e., in a portion of the electron lens electrode 11*a* opposing the light-incident portion 5. In FIG. 6, a portion 15*b* located on the left side of the opening 15*a* has a cell structure in which a large number of small parabolic holes are aligned in the vertical direction. A large number of small rectangular holes are formed in a portion 15C, located on the right side of the opening 15a, in the vertical direction.

The potential of the electron lens electrode 11a is set to be the same as that of the photocathode 2, or is optimized as an electron lens. Hence, most of the photoelectrons emitted from the photocathode 2 are deflected by the electron lens electrode 11a and directed to the first-stage dynode 3a of the electronic multiplier section 3, as indicated by a broken arrow in FIG. 7. In order to cause the photoelectrons emitted from the photocathode 2 to be effectively incident on the first-stage dynode 3a, it suffices if an electrode having a certain width is arranged at a portion of the electron lens electrode 11a contacting the photocathode 2, and at a portion of the electron lens electrode 11a adjacent to the outer periphery of the first-stage dynode 3a. This is apparent from various experiments. Hence, it is preferable that the opening 15a of the electron lens electrode 11a is set as large as possible while leaving electrode portions sufficient for not disturbing the path of the photoelectrons.

Figure 10:
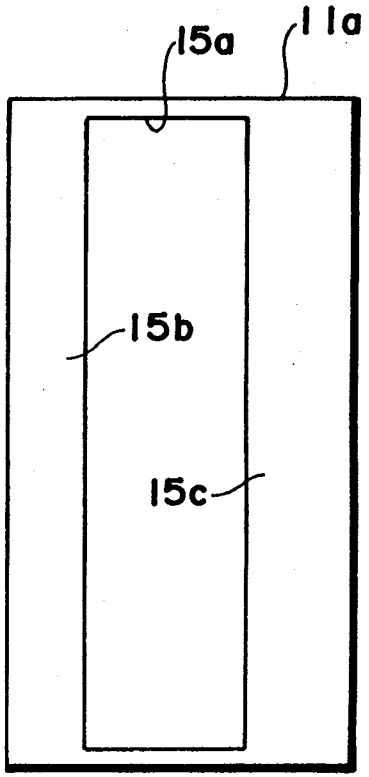
FIGS. 8 to 10 are front views showing modifications of electron lens electrodes applicable to the photomultiplier of the present invention.
Figure 9:
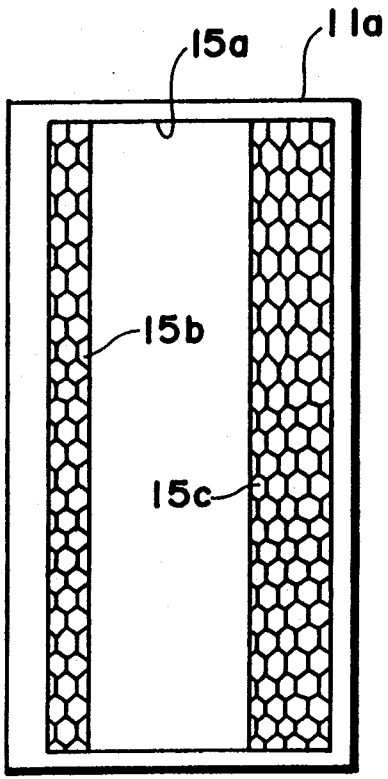
Figure 8:
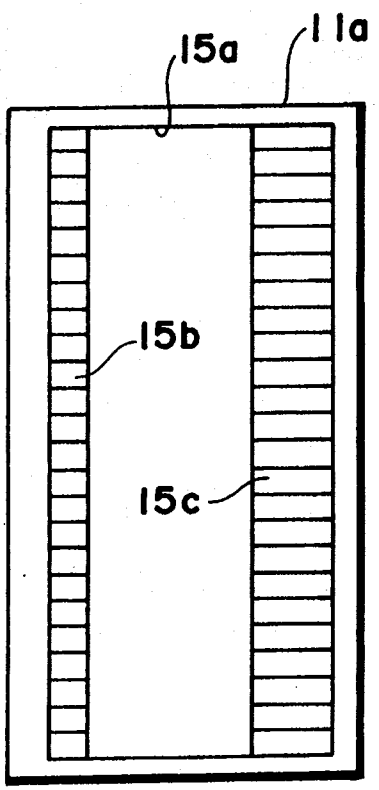

From this point of view, the electron lens electrode 11a can be of various other shapes, in addition to that shown in FIGS. 6 and 7. For example, in an electron lens electrode 11a shown in FIG. 8, a left cell structure portion 15b is constituted by small rectangular holes, in the same manner as a right cell structure portion 15c. As shown in FIG. 9, right and left cell structure portions 15c and 15b may have honeycomb structures. As shown in FIG. 10, right and left cell structure portions 15c and 15b may be flat plates having no holes. Furthermore, as shown in each of FIGS. 11 to 13, a left portion 15b may be narrowed to a width sufficient for being welded to a support rod 12a in order to enlarge an opening 15a. In this case, the left portion 15b does not include a cell structure.

Figure 13:
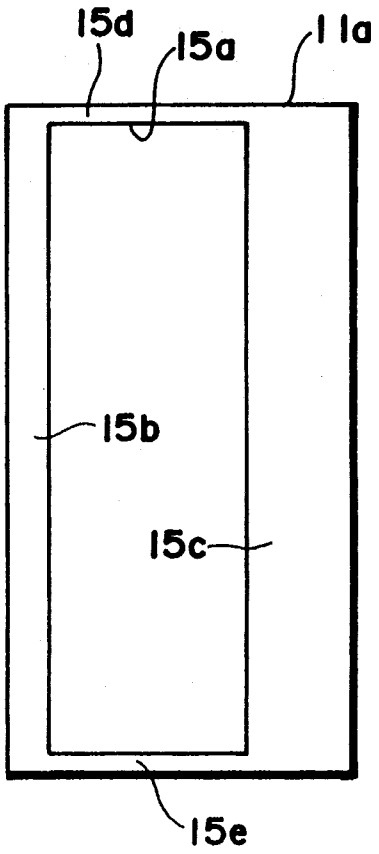
FIGS. 11 to 13 are front views showing other modifications of electron lens electrodes applicable to the photomultiplier of the present invention.
Figure 12:
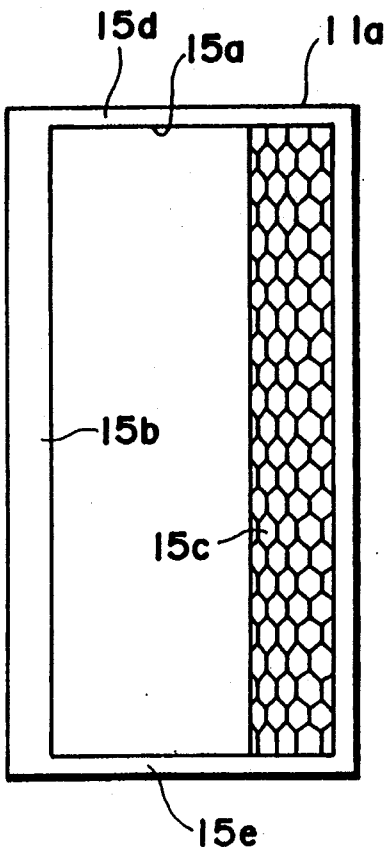
Figure 11:
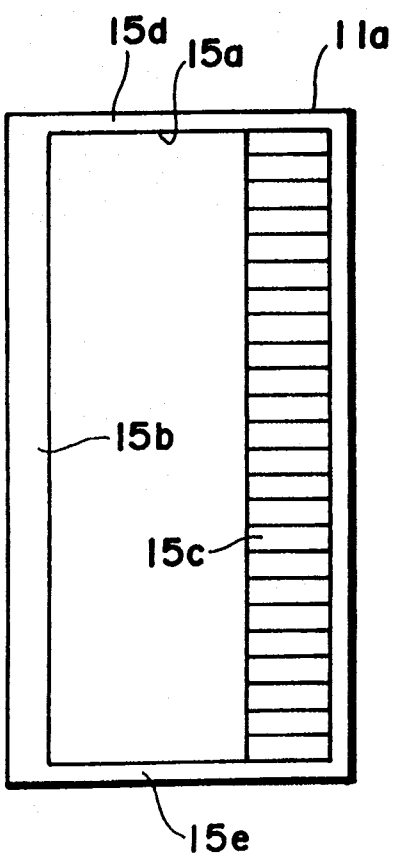
Figure 14:
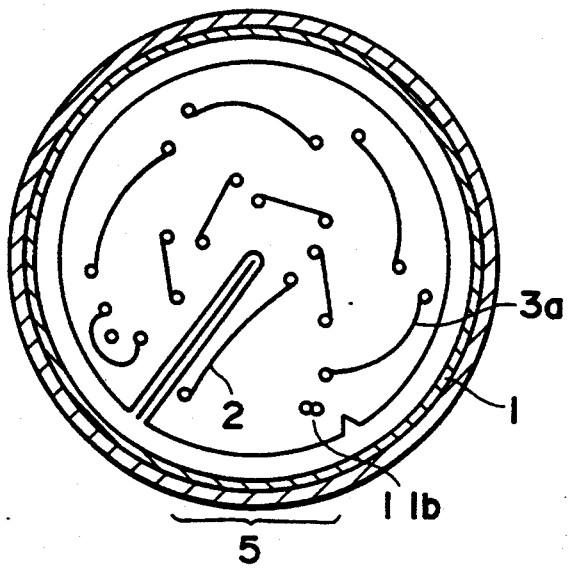
FIG. 14 is a sectional view, similar to FIG. 7, showing a photomultiplier according to the present invention in which an electron lens electrode constituted by two electrode rods is provided.
Figure 15:
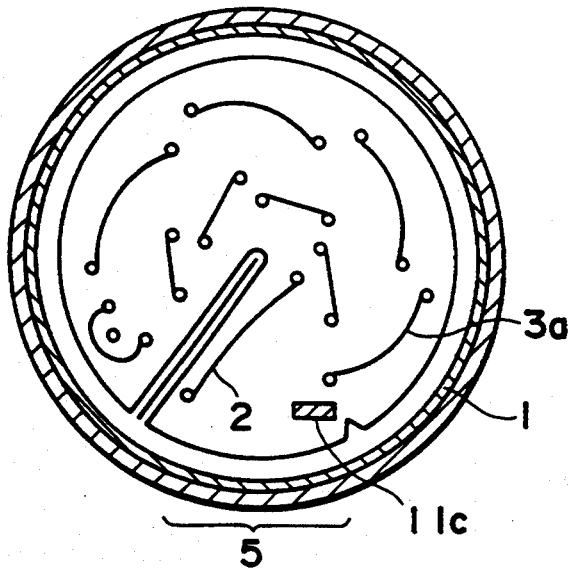
FIG. 15 is a horizontally sectional view showing a photomultiplier according to the present invention in which a flat narrow electron lens electrode is provided.

Regarding an electron lens electrode 11a shown in each of FIGS. 11 to 13, its function of deflecting photoelectrons depends substantially only on its right portion 15c. Hence, it is obvious that an electron lens electrode having an operation substantially the same as those shown in FIGS. 11 to 13 can be obtained even if its upper and lower portions 15d and 15e and its left portion 1b are removed. Accordingly, as shown in FIG. 14, an electron lens electrode 11b may be constituted by two electrode rods, and arranged a position adjacent to a first-stage dynode 3a and opposing part of a light-incident portion 5 of a glass bulb 1. Alternatively, even when a flat electron lens electrode 11c is arranged at the same position as in FIG. 14, as shown in FIG. 15, most of the photoelectrons emitted from a photocathode 2 are incident on a first-stage dynode 3a.

Figure 16:
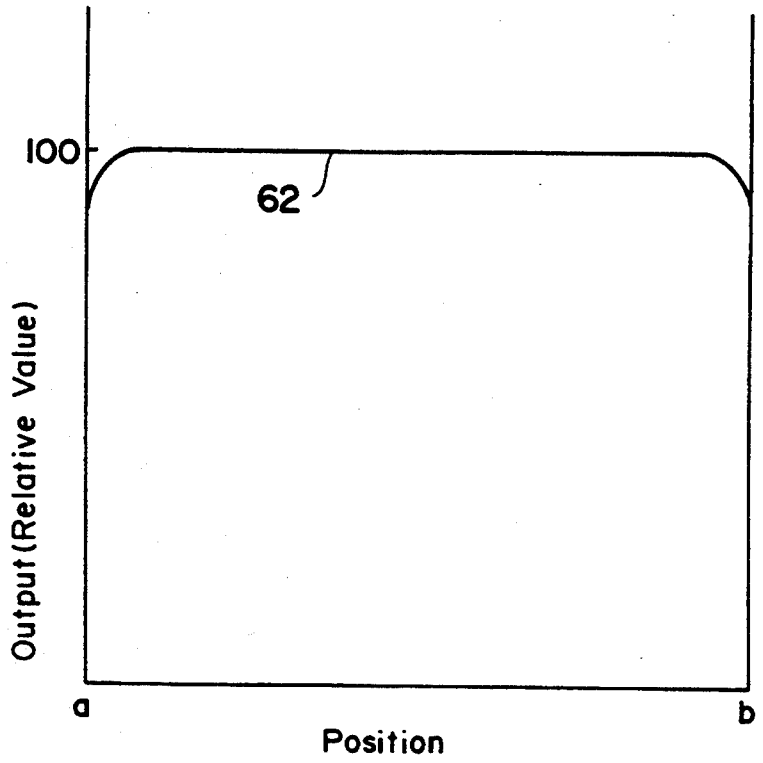
FIG. 16 is a graph showing the relationship between the position of a light spot formed and the output when spot light is radiated on the photomultiplier of FIG. 6.

In this manner, with the use of the electron lens electrode 11a having the opening 15a, or the narrow electron lens electrode 11b or 11c arranged only on the side of the first-stage dynode 3a, a portion of the glass bulb 1 opposing the light-incident portion 5 is widely opened. Then, light incident through the light-incident portion 5 directly reaches the photocathode 2 without being scattered or absorbed. For example, when spot light is radiated from the point a to point b along the plane 7—7 of FIG. 6, the waveform 62 of an output signal derived from the anode 4 is uniform, as shown in FIG. 16. In this manner, as the uniformity of the output signal is maintained and a loss in light is eliminated in the electron lens electrode 11a, 11b, or 11c, the S/N ratio of the photomultiplier is improved.

The conventional grid electrode 6 shown in FIG. 1 also has a function of improving the hysteresis characteristics, in addition to the function as the electron lens. Hysteresis is a phenomenon in which when pulse light is incident on a photomultiplier, an output signal does not rise immediately but rises gradually and is stabilized. It is supposed that when the hysteresis occurs, photoelectrons emitted from the photocathode 2 collide against the light-incident portion 5 of the glass bulb 1 to electrically charge this portion, and the potential of this portion becomes unstable to adversely affect the path of the photoelectrons. In the conventional grid electrode 6, the conductor wire 6c is arranged entirely in front of the photocathode 2 to shield the photoelectrons emitted from the photocathode 2 toward the light-incident portion 5.

Figure 17:
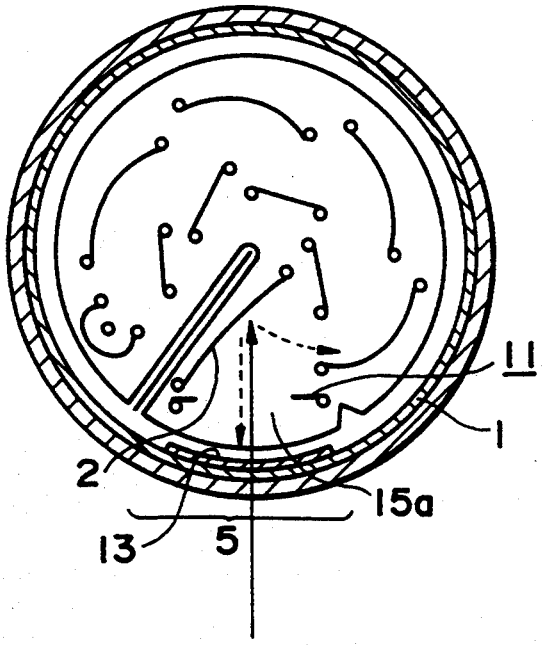
FIG. 17 is a horizontally sectional view showing a photomultiplier according to the present invention in which a transparent conductor portion is formed.

In the present invention, however, since the large opening 15a is formed in the electron lens electrode 11a, the photoelectrons may partly reach the light-incident portion 5 of the glass bulb 1. In order to prevent this, according to the present invention, a transparent conductor portion 13 is formed on the inner wall surface of the light-incident portion 5 of the glass bulb 1, as shown in FIG. 17. As the resistance of a portion of the light-incident portion 5 on which the conductor portion 13 is formed is decreased, even if the photoelectrons emitted from the photocathode 2 reach the inner wall surface of the glass bulb 1 through the opening 15a of the electron lens electrode 11a, this portion of the inner wall surface of the glass bulb 1 is not substantially charged. As a result, the potential of the light-incident portion 5 of the glass bulb 1 is stabilized to improve the hysteresis characteristics.

The conductor portion 13 can be formed by various methods, and is preferably formed by depositing chromium on the inner wall surface of the glass bulb 1. Since a deposited chromium film has a high transmittance of 98%, a loss in light transmitted through the chromium film is very small.

In order to prevent the light-incident portion 5 of the glass bulb 1 from being electrically charged, a transparent conductor portion 5 may be formed on the outer wall surface of the glass bulb 1 to obtain the same effect.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A photomultiplier comprising:

a translucent sealed container;

a reflection type photocathode provided in said translucent sealed container, said reflection type photocathode receiving light passing through a light-incident portion of said translucent sealed container and generating photoelectrons;

an electron multiplier section provided in said translucent sealed container and including a plurality of stages of dynodes, said electrons multiplier section multiplying photoelectrodes emitted from said reflection type photocathode; and an electron lens electrode, said electron lens electrode being a plate electrode and directing photoelectrons emitted from said reflection type photocathode to said electron multiplier section, said electron lens electrode being provided in said translucent sealed container between said reflection type photocathode and said light-incident portion of said translucent sealed container and having an opening defined therein for allowing light which passes through said light-incident portion of said translucent sealed contain to be provided to said reflection type photocathode without substantial interference from said electron lens electrode.

2. A photomultiplier according to claim 1, wherein a transparent conductor portion is formed on an inner wall surface of said light-incident portion of said sealed container.

3. A photomultiplier according to claim 1, wherein a transparent conductor portion is formed on an outer wall surface of said light-incident portion of said sealed container.

4. A photomultiplier comprising:

a translucent sealed container;

a reflection type photocathode provided in said translucent sealed container, said reflection type photocathode receiving light which passes through a light-incident portion of said translucent sealed container and generating photoelectrons;

an electron multiplier section provided in said translucent sealed container and including a plurality of stages of dynodes, said electron multiplier section multiplying photoelectrons emitted from said reflection type photocathode; and an electron lens electrode for directing photoelectrons emitted from said reflection type photocathode to said electron multiplier section, said electron lens electrode provided in said translucent sealed container and located at a position adjacent to a first-stage dynode in said plurality of stages of dynodes and opposing part of said light-incident portion of said translucent sealed container, wherein photoelectrons that reach said reflection type photocathode pass through a surface defined between said electron lens electrode and said reflection type photocathode.

5. A photomultiplier according to claim 2, wherein a transparent conductor portion is formed on an inner wall surface of said light-incident portion of said sealed container.

6. A photomultiplier according to claim 2, wherein a transparent conductor portion is formed on an outer wall surface of said light-incident portion of said sealed container.

* * * * *